US005511953A

United States Patent [19]

Holzheimer et al.

[11] Patent Number: 5,511,953

[45] Date of Patent: Apr. 30, 1996

[54] MECHANICAL COMPRESSOR SYSTEM

[75] Inventors: Günter Holzheimer, Baiersdorf; Hans R. Neubauer, Weisendorf; Manfred Stretz, Erlangen, all of Germany

[73] Assignee: Siemens Aktiengesellschaft, Munich, Germany

[21] Appl. No.: 287,024

[22] Filed: Aug. 8, 1994

[30] Foreign Application Priority Data

Aug. 11, 1993 [DE] Germany ..... 43 27 003.4
Mar. 16, 1994 [DE] Germany ..... 9404463 U

[51] Int. Cl.[6] ..... F04C 19/00; F28B 3/04; F28B 9/08

[52] U.S. Cl. ..... 417/68; 418/85

[58] Field of Search ..... 417/68, 69; 418/83, 418/85, 86

[56] References Cited

U.S. PATENT DOCUMENTS

| | | | |
|---|---|---|---|
| 1,991,548 | 2/1935 | DeMotte | 417/68 |
| 3,765,755 | 1/1974 | Novak et al. | 418/85 |
| 4,257,749 | 3/1981 | Ramm | 417/68 |

FOREIGN PATENT DOCUMENTS

| | | | |
|---|---|---|---|
| 0486726 | 5/1992 | European Pat. Off. | 417/68 |

OTHER PUBLICATIONS

Prospectus by Sihi–Halberg: *Flüssigkeitsring–Gaspumpen—Anleitung zur Asuwahl der geeigneten Betriebsflüssigkeit und deren Schaltung*, p. 2, Fig. 2.

*Primary Examiner*—Richard E. Gluck
*Attorney, Agent, or Firm*—Kenyon & Kenyon

[57] ABSTRACT

A mechanical compressor system is provided. In the system, a suction line is connected to a first connecting port of a liquid ring compressor, and an exhaust line is connected to a second connecting port of the same. An after-cooler unit is provided which consists of two separate chambers having at least one separating wall and which is arranged with its first chamber in the suction line and with its second chamber in the exhaust line. At least one injection line is provided for injecting fluid from the return line into the suction line upstream from the after-cooler unit, or in the after-cooler unit. Thus, the gaseous working fluid is allowed to be cooled to process-compatible temperatures with only a low power demand and little additional expenditure for installation.

19 Claims, 2 Drawing Sheets

MECHANICAL COMPRESSOR SYSTEM

FIELD OF THE INVENTION

The present invention relates to a mechanical compressor system, and more particularly to a liquid ring compressor system that cools the working fluid after compression to a temperature which is compatible with a process.

BACKGROUND OF THE INVENTION

Mechanical compressors, such as rotary sliding-vane compressors or liquid-ring compressors, are usually required in process systems to maintain the circulation of the working fluid. After flowing through the compressor, the gaseous working fluid is compressed and, in many cases, is very hot. If so, the compressed gas must be cooled to a temperature that is compatible with the process. Known gas-cooling measures require considerable additional expenditure for installation and also a significant expenditure of power.

There is a need for a mechanical compressor which cools the compressed gaseous working fluid to a temperature which is compatible with the process.

SUMMARY OF THE INVENTION

A mechanical compressor is provided with an after-cooler unit which is comprised of two separate chambers having at least one common separating wall. The first chamber of the after-cooler unit is arranged to engage the flow of the working fluid in the suction line. The working fluid which flows through the suction line will also be termed in the following as "vacuum intake air". The second chamber of the after-cooler unit is arranged in the pressure-media line to engage the flow of the working fluid exhausted by the compressor. The pressure-media line will also be termed in the following was the "exhaust line" or the "connecting line", depending upon the embodiment chosen. In embodiments with a separate separator, there will be both an exhaust line and a connecting line. The working fluid which flows through the pressure-media line will be referred to in the following as "exhaust air".

The principle of cooling the exhaust-air is not limited to rotary-vane and rotary-piston pumps, but is also suited to other mechanical compressors, such as liquid-ring compressors. In the case of liquid-ring compressors, this principle offers the advantage that an additional portion of working fluid is condensed out of the exhaust air because of the cooling of the exhaust air. After condensation, the working fluid can be recirculated into the liquid circulation circuit. The principle of exhaust-air cooling in accordance with the invention not only leads, therefore, to the desired cooling of the exhaust air, but also makes it possible for the operating fluid to be recovered. As a result the operating fluid circuit need only occasionally be supplemented with a reduced quantity of working fluid. A constantly rising concentration of chemical components, solids, and lime in the working fluid, as well as the resultant corrosion, contamination, and calcification, are thus reliably avoided or at least delayed.

When a liquid-ring compressor is used as a mechanical compressor, several other advantages are attained over a rotary-vane pump. A liquid-ring compressor is less sensitive to contamination by solids caused by the discharge medium than is a rotary-vane pump. In addition, a liquid-ring compressor acts to clean the gas, since it adsorbs the solids out of the working fluid (e.g., dust), and causes the solids to precipitate out in the separator. Moreover, the impeller of a liquid-ring compressor works in a contact-free manner. Thus, contrary to the rotary vane pump, it is substantially free of wear and tear.

The after-cooler unit may be any chambered after-cooler unit with at least one separating wall that acts as a heat-transfer surface between the suction line and the exhaust line. This can also be achieved, for example, by an intermeshing network of tubing.

DETAILED DESCRIPTION

Figure 1:
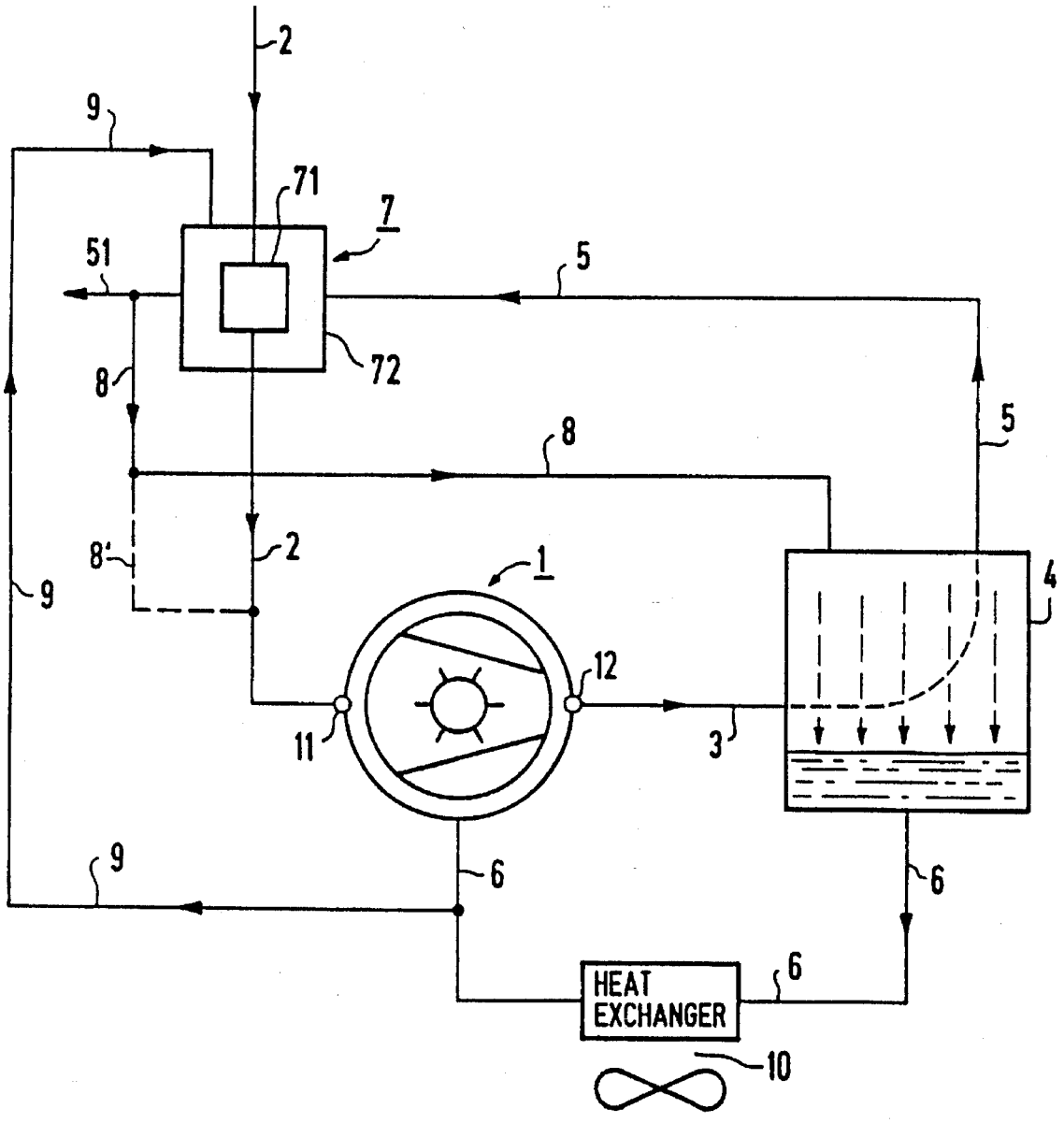
FIG. 1 shows a first embodiment of a mechanical compressor according to the present invention.

FIG. 1 illustrates a mechanical compressor. In this embodiment, a liquid-ring compressor 1 is shown. A suction line 2 is connected to a first connecting port 11 of the liquid-ring compressor 1. From the liquid-ring compressor 1, a second connecting port 12 connects to a separator 4 via a connecting line 3. The second connecting port 12 functions in the opposite direction to that of the first connecting port 11.

An exhaust line 5 runs out of the separator 4. The separator 4 is also connected via a return line 6 to the liquid-ring compressor 1.

In addition, the liquid-ring compressor 1 has an after-cooler unit 7 to cool the exhaust air. The after-cooler unit 7 has a first chamber 71 in the suction line 2 and has a second chamber 72 in the exhaust line 5. A condensation line 8 branches off of an end 51 of the exhaust line 5 which leads out from the after-cooler unit 7. From the condensation line 8, the condensed working fluid is recirculated into the separator 4 and, thus, into the liquid circulation circuit (solid line 8). This liquid may also be provided to the gas circuit (dotted line 8').

The condensation line 8 need not branch off from the end 51 of the exhaust line 5; rather, the condensation line 8 can also be brought out directly (not shown) from the second chamber 72 of the after-cooler unit 7 and then, in turn, discharge into the suction line 2 or into the separator 4.

The arrangement of the after-cooler unit 7 is not limited to the exemplified embodiment shown in the drawing. The after-cooler unit 7 may also be seated directly on an exhaust nipple of the separator 4 (not shown). An advantage of this embodiment is that the condensed working fluid gravitationally falls back directly into the separator 4. As a result, the condensation line 8 may be dispensed with.

Part of the working fluid is also recirculated into the suction line. Working fluid is injected upstream of the after-cooler unit 7 via an injection line 9. In the depicted embodiment, the injection line 9 branches off of the return line 6, and is fluidly connected to the suction line 2 at a point upstream from the first chamber 71. The working fluid, separated in the separator 4, is cooled by a heat exchanger 10 arranged in the return line 6. This heat exchanger 10 may be, for example, an air cooler. Thus, only cooled working fluid is injected via the injection line 9 into the suction line 2.

The exhaust air in the exhaust line 5 is warmer than the vacuum intake air in the suction line 2. Thus, a heat exchange takes place in the after-cooler unit 7 between the exhaust air and the vacuum intake air. To intensify the cooling of the exhaust air, liquid, preferably water, is also injected via the injection line 9 into the suction line 2. The liquid, which evaporates during the injection operation, partially or completely saturates the vacuum intake air. The heat of evaporation required to vaporize the injected liquid is extracted from the vacuum intake air, thus cooling the vacuum intake air flowing in the suction line 2. As a result, the temperature gradient between the vacuum intake air and the exhaust air is increased. Thus, the exhaust air is cooled more intensely due to the improved heat exchange.

The liquid-ring compressor 1 shown in FIG. 1 works in a closed working fluid cycle. As a result, depending upon the suction pressure, it is only necessary to add a small amount of working fluid or perhaps none at all. This use of the same medium reliably prevents or delays corrosion caused by chemical components, as well as the contamination caused by solids. It also helps prevent calcification.

Figure 2:
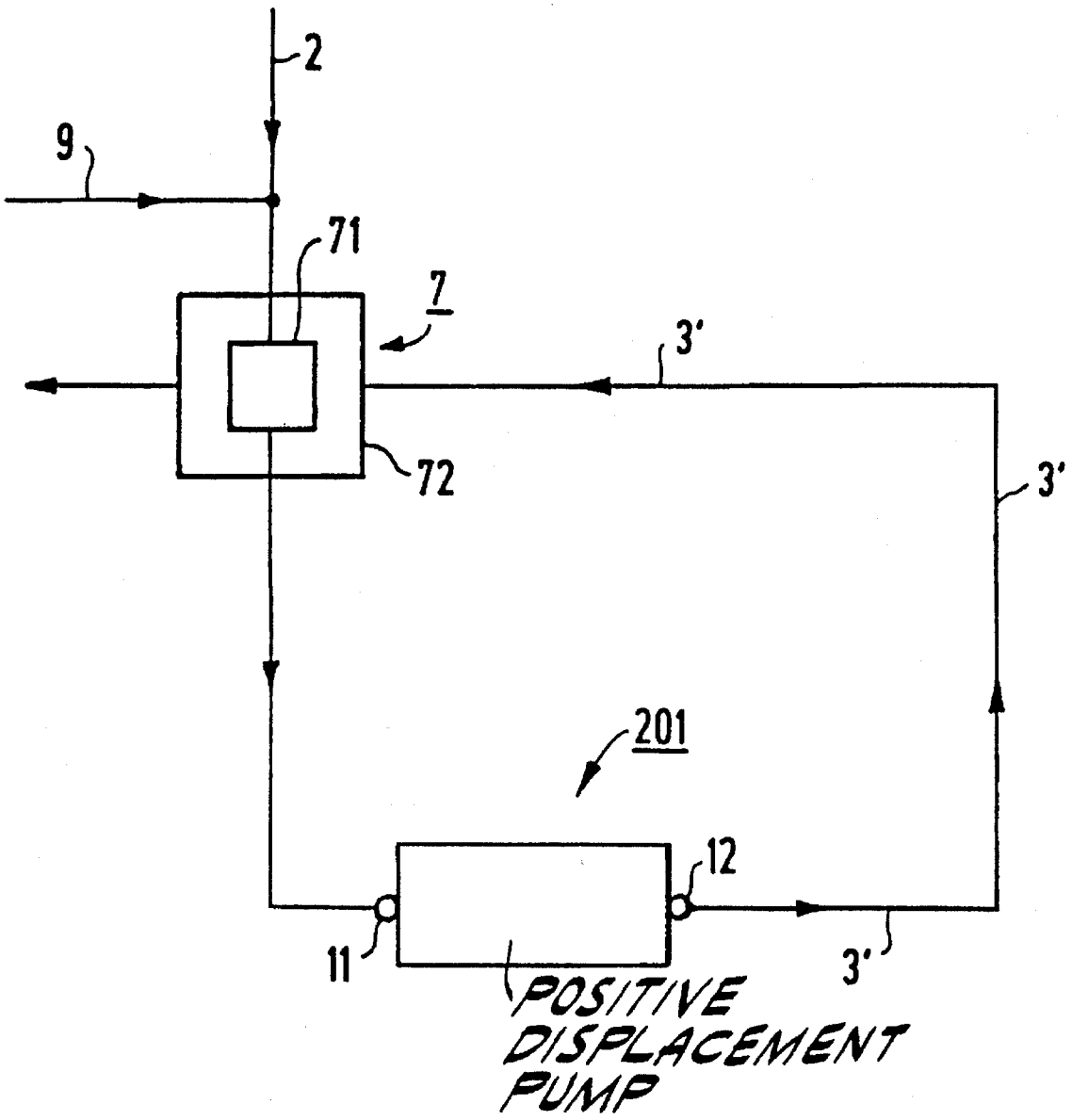
FIG. 2 shows a second embodiment of a mechanical compressor according to the present invention.

The principle of exhaust-air cooling according to the present invention is not only limited to liquid-ring compressors, but is also suited for all mechanical compressors. FIG. 2 illustrates an embodiment of a nonlubricated positive-displacement pump, which is designated by pump 201. The suction line 2 is connected to the first connecting port 11 of the positive-displacement pump 201 through the after-cooler unit 7. An exhaust line 3' is connected to the oppositely working, second connecting port 12 of the positive-displacement pump 201. This exhaust line 3' connects directly to the after-cooler unit 7. The after-cooler unit 7 is arranged with the first chamber 71 in the suction line 2 and the second chamber 72 in the exhaust line 3'.

Cooled liquid is injected via the injection line 9 upstream from the after-cooler unit 7 into the suction line 2. This liquid can be taken, for example, from the process circulation circuit (not shown). The cooling effect described with respect to the embodiment of FIG. 1 is again achieved as the result of injecting liquid into the suction line 2.

A mechanical compressor is provided which cools the compressed working fluid to a temperature which is compatible with the process. This compressor requires low power and only little additional expenditure for installation.

What is claimed is:

1. A compressor system, comprising:

a mechanical compressor with a first connecting port and a second connecting port;

a suction line connected to said first connecting port;

an exhaust line connected to said second connecting port;

an after-cooler unit, including:

a first chamber, said suction line passing through said first chamber;

a second chamber, said exhaust line passing through said second chamber;

at least one separating wall separating said first chamber and said second chamber; and at least one injection line injecting fluid into said suction line upstream from said after-cooler unit.

2. A compressor system, comprising:

a mechanical compressor with a first connecting port and a second connecting port;

a suction line connected to said first connecting port;

an exhaust line connected to said second connecting port;

an after-cooler unit, including:

a first chamber, said suction line passing through said first chamber;

a second chamber, said exhaust line passing through said second chamber;

at least one separating wall separating said first chamber and said second chamber; and at least one injection line injecting fluid into said suction line at a point within said after-cooler unit.

3. The system of claim 1, wherein said mechanical compressor is a liquid-ring compressor.

4. The system of claim 3, further comprising:

a separator located in the exhaust line between said liquid-ring compressor and at least said second chamber of said after-cooler unit;

a return line located between said separator and said liquid-ring compressor;

a condensate line located between said second chamber of said after-cooler and said suction line, said condensate line connecting to said suction line at a point on said suction line between said after-cooler and said liquid-ring compressor.

5. The system of claim 3, further comprising:

a separator located in the exhaust line between said liquid-ring compressor and at least said second chamber of said after-cooler unit;

a return line located between said separator and said liquid-ring compressor;

a condensate line located between said second chamber of said after-cooler and said separator.

6. The system of claim 4, further comprising a heat exchanger located in the return line.

7. The system of claim 5, further comprising a heat exchanger located in the return line.

8. The system of claim 4, wherein said injection line is located between said suction line and said return line.

9. The system of claim 6, wherein said heat exchanger is an air cooler.

10. The system of claim 7, wherein said heat exchanger is an air cooler.

11. The system of claim 1, wherein said mechanical compressor is a positive displacement pump.

12. The system of claim 2, wherein said mechanical compressor is a liquid-ring compressor.

13. The system of claim 12, further comprising:

a separator located in the exhaust line between said liquid-ring compressor and at least said second chamber of said after-cooler unit;

a return line located between said separator and said liquid-ring compressor;

a condensate line located between said second chamber of said after-cooler and said suction line, said condensate line connecting to said suction line at a point on said suction line between said after-cooler and said liquid-ring compressor.

14. The system of claim 12, further comprising:

a separator located in the exhaust line between said liquid-ring compressor and at least said second chamber of said after-cooler unit;

a return line located between said separator and said liquid-ring compressor;

a condensate line located between said second chamber of said after-cooler and said separator.

15. The system of claim 13, further comprising a heat exchanger located in the return line.

16. The system of claim 14, further comprising a heat exchanger located in the return line.

17. The system of claim 13, wherein said injection line is located between said suction line and said return line.

18. The system of claim 15, wherein said heat exchanger is an air cooler.

19. The system of claim 2, wherein said mechanical compressor is a positive displacement pump.

* * * * *